United States Patent [19]

Bleckmann

[11] 4,326,552

[45] Apr. 27, 1982

[54] HEATER FOR HEATING FLOWS OF FLUID AND DISHWASHING MACHINE PROVIDED THEREWITH

[76] Inventor: Ingo Bleckmann, Ignaz-Rieder-Kai 11, A-5020 Salzburg, Austria

[21] Appl. No.: 114,395

[22] Filed: Jan. 22, 1980

[30] Foreign Application Priority Data

Jan. 23, 1979 [DE] Fed. Rep. of Germany ... 7901761[U]
Jul. 18, 1979 [EP] European Pat. Off. ..... 79102505.9

[51] Int. Cl.[3] ..... B08B 3/02

[52] U.S. Cl. ..... 134/99; 134/107; 219/283; 219/299

[58] Field of Search ..... 134/99, 103, 105, 106, 134/107, 108; 219/283, 296, 298, 299

[56] References Cited

U.S. PATENT DOCUMENTS 1,825,793 10/1931 Heroy ..... 219/298 X
2,437,453 3/1948 Belgau ..... 219/299 X
3,023,757 3/1962 Mixon ..... 134/99

FOREIGN PATENT DOCUMENTS 372435 11/1963 Switzerland ..... 134/99
1038837 8/1966 United Kingdom ..... 134/108

*Primary Examiner*—Robert L. Bleutge
*Attorney, Agent, or Firm*—Fleit & Jacobson

[57] ABSTRACT

A heater for heating at least two separate fluid flows comprises a heater arrangement mounted on an inner pipe through which one of the fluids flows and which is surrounded by an outer pipe through which the other fluid flows over the heater arrangement. The fluid flowing through the inner pipe may be dish-washing liquid for a dishwashing machine, while the fluid flowing through the outer pipe and over the heater may be dish-drying air.

14 Claims, 2 Drawing Figures

HEATER FOR HEATING FLOWS OF FLUID AND DISHWASHING MACHINE PROVIDED THEREWITH

BACKGROUND OF THE INVENTION

Dishwashing machines are known, such as for domestic use, which comprise an electrical heater for heating the dishwashing liquid and for drying the dishes, such heater being generally in the form of a continuous heater, that is to say, it heats fluid passing thereover, as contrasted to heating fluid in a storage tank.

One form of such heater in a dishwashing machine is a bar-like electrical tubular heater, which is disposed in the tank or tub which receives the crockery and the like to be washed. During the dishwashing operation, a part of the washing liquid which is sprayed within the tub for example by distributor arms impinges on the tubular heater so that the washing liquid is heated and the tubular heater is accordingly cooled down. This construction suffers from the disadvantage that dirt and residues from the dishwashing agents remain adhering to and dry on the surface of the heater so that the output of heat from the tubular heater is detrimentally affected. In many cases the heater is masked from the jets or sprays of washing liquid by pieces of crockery so that the tubular heater may suffer from local over-heating, where the washing liquid does not impinge thereon. The crockery is subsequently dried by the radiant heat produced by the tubular heater, so that the drying operation is accordingly irregular; more specifically, items disposed in the region of the heater or in the direct range of radiant heat produced by the heater are heated to a greater degree than items which are further away from the heater or which may be masked by other items in the dishwashing machine. The irregular transfer of heat to the washing liquid and to the crockery in the drying operation results in an increase in the amount of power consumed by the machine.

SUMMARY OF THE INVENTION

An object of the invention is to provide a dishwashing machine which does not suffer from the above-mentioned disadvantages of the prior-art machine discussed.

Another object of the invention is to provide a dishwashing machine in which both the dishwashing liquid and an air flow for drying the washed dishes are heated by means of an electrical heater.

A further object of the invention is to provide a dishwasher comprising a single heating arrangement for heating both the dishwashing liquid and the drying air flow, while providing a uniform transfer of heat from the heater arrangement to the dishwashing liquid and the drying air flow respectively, resulting in a saving in power consumption.

A still further object of the invention is to provide a continuous-type heater for heating at least two separate fluid flows while keeping such flows separated from each other.

These and other objects are achieved by a heater arrangement which is disposed on a first pipe or conduit for a first fluid such as a dishwashing liquid, for example water, whereby the heater arrangement heats the washing liquid flowing through the first conduit, a second conduit being disposed around the assembly of the first conduit and the heater arrangement, with the second fluid flow to be heated flowing through the second conduit and thus flowing over the heater arrangement, thereby to be heated.

In a dishwashing machine, the above-indicated assembly comprising the first and second conduits and the heater arrangement may be disposed in the base of or below the bottom of the washing and drying tub or vessel of the machine so that the washing liquid which flows into the tub through the first conduit is heated by the heater arrangement for the washing operation, while the drying air which is introduced by way of the second conduit is heated by flowing over the heater arrangement.

Further objects and features of the present invention will be apparent from the following description of a preferred embodiment of the invention.

DESCRIPTION OF THE PREFERRED EMBODIMENT

Figure 1:
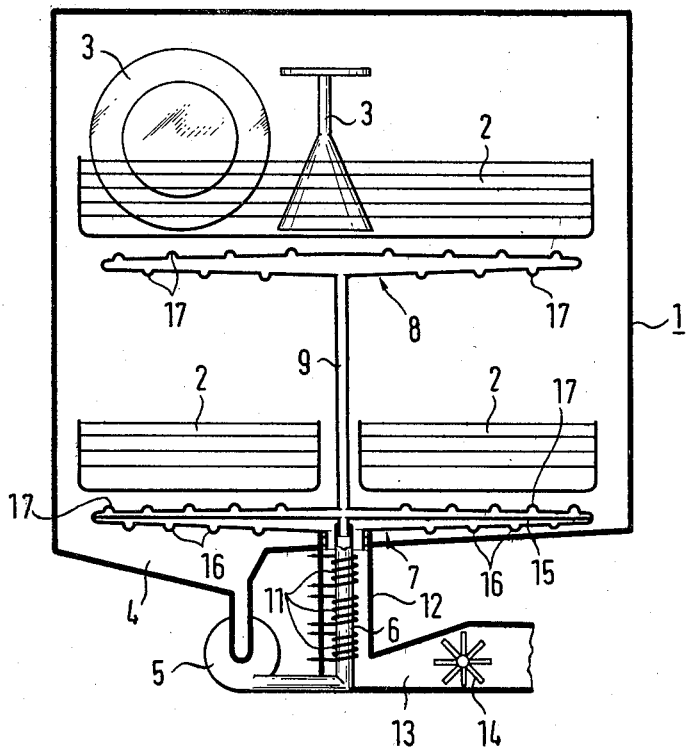
FIG. 1 is a diagrammatic sectional view of a preferred embodiment of a dishwashing machine incorporating the heater of the invention.

Referring firstly to FIG. 1, a dishwashing machine of domestic type comprises a housing 1 containing a plurality of baskets 2 which can generally be extended from and retracted into the casing 1, for carrying the articles 3 to be washed. The machine has a collecting sump or tank 4 for collecting the washing liquid which comes off the articles 3 and which is passed from the tank 4 by way of a pump 5 and a supply pipe or conduit 6 to a rotatable distributor arrangement comprising a lower distributor arm 7 and an upper distributor arm 8. The distributor arms 8 are secured to a pipe member 9 for carrying the washing liquid.

Disposed on the conduit 6 is a heater arrangement 11 comprising a plurality of, there being three shown, tubular heater members which are each wound in a coil configuration around the conduit 6. Disposed around the assembly of the heater arrangement 11 and the conduit 6 is a second pipe or conduit 12 which is thus of larger diameter than the conduit 6 and which is disposed concentrically with respect to the axis of the conduit 6 and the axis of the coil of the heater arrangement 11. An air conduit 13 is connected to the conduit 12 so that air which is drawn into the conduit 13 by a blower 14 is driven through the annular passage defined between the inner conduit 6 with heater arrangement 11, and the outer conduit 12, during a dish drying operation.

The assembly comprising components 7, 8 and 9 is supported rotatably at the upper ends of the conduits 6 and 12. The lower distributor arm 7 is divided into two regions in the interior thereof by a dividing wall 15 which extends in the longitudinal direction of the arm 7. The lower part of the interior of the distributor arm 7 is in communication with the annular passage defined between the conduits 6 and 12 so that the air which is drawn in by the blower 14 and which passes through the conduit 12 over the heater arrangement 11 is blown into the interior of the tank or tub 1 of the machine, by means of air nozzles 16. The upper part of the interior of the distributor arm 7 and the interior of the distributor arm 8 are in communication with the interior of the conduit 6 so that the washing fluid which is displaced by the pump 5 is sprayed out on to the items of crockery 3 to be washed by way of spray nozzles 17.

Figure 2:
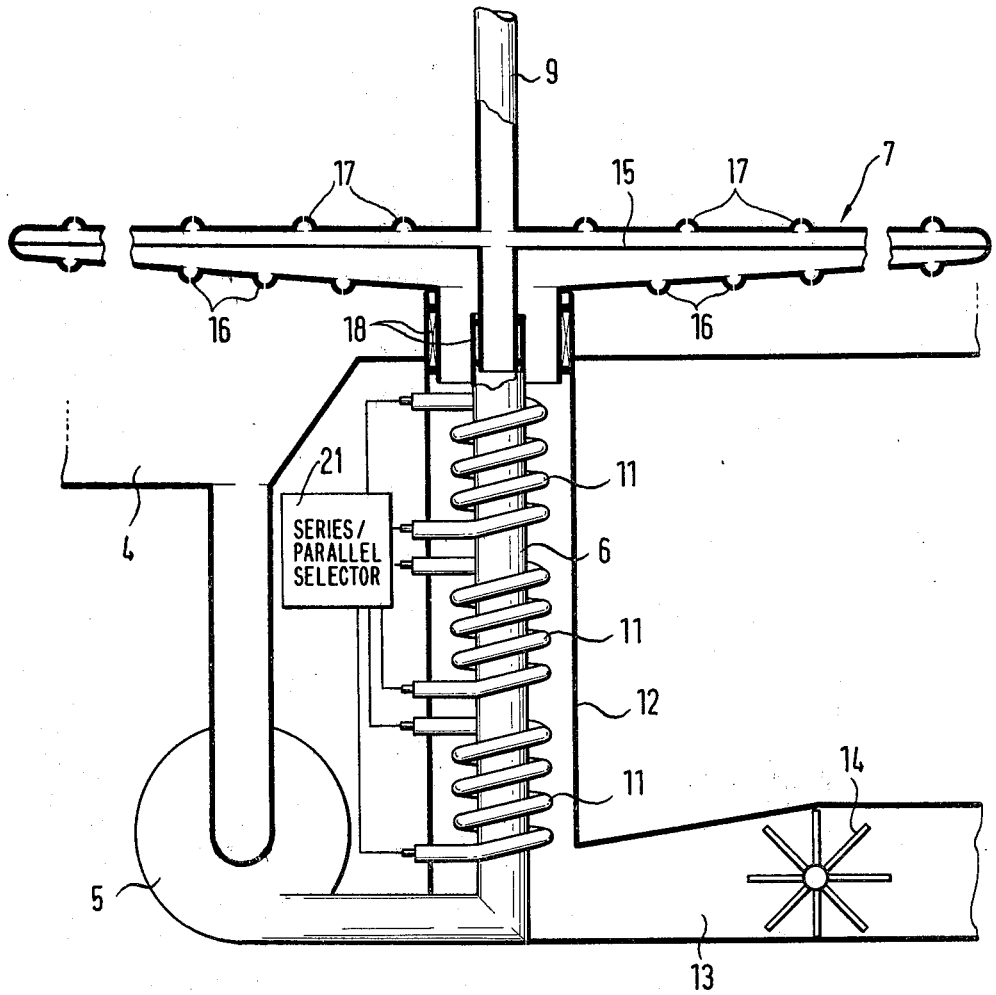
FIG. 2 shows a sectional view of the bottom part of the dishwashing machine of FIG. 1, on a larger scale.

Referring now also to FIG. 2, it will be seen that the arrangement, which is a rigid structure, comprising the pipe 9 and the distributor arms 7 and 8, is rotatably mounted by means of rotary bearings 18 disposed at the upper ends of the conduits 6 and 12. The distributor arms 7 and 8 are caused to rotate in known manner by the recoil or repulsion of the flows of fluid issuing from the respective nozzles 16 and 17, which are therefore suitably inclined for this purpose.

The above-described construction enjoys a number of advantages, as follows:

The washing liquid does not come into contact with the heater arrangement 11 so that there is no possibility of matter in the washing liquid being disposited on the heater arrangement and causing local over-heating thereof. Accordingly, the tubular casing of the heater arrangement 11 does not need to comprise expensive chromium-nickel steels which in addition would also have to be given particular protection from stress crack corrosion. It will be appreciated that, when a heater arrangement in known designs of dishwashing machines is subject to stress crack corrosion, there is then the danger of the washing liquid penetrating into the heater arrangement and therefore causing leakage of voltage to the entire machine. There is no possibility of this occurring in the construction according to the invention so that there is no need for the specific safety precautions which would otherwise be required in this respect. The heater arrangement 11 is also protected by the conduit 12. The tub or vessel 1 may correspondingly also comprise plastic material as there is no danger of the plastic vessel being set on fire by radiant heat or by liquid metal being sprayed thereonto, which could occur in the event of a tubular heater in the conventional arrangement suffering from severe over-heating. In addition, the transfer of heat is extremely good, both to the flow of washing liquid and also to the flow of drying air, thereby achieving a corresponding reduction in power consumption. As the heater arrangement 11 is mounted on the tube 6, in the form of a coil, the flow of air is caused to rotate as it flows over the heating arrangement and is given a corresponding eddy or vortex configuration resulting in good heat exchange. The amount of power required during the drying operation is accordingly low so that it is sufficient for the heaters of the heater arrangement 11 of the described and illustrated embodiment to be connected in series for the drying operation. During the operation of heating up the washing liquid for washing the items of crockery 3, the heaters of the heater arrangement 11 are desirably connected in parallel so as to provide the minimum possible heating-up time. This parallel connection can be retained during the washing process. However, it is also possible at that time to switch off one of the heaters of the heater arrangement 11, or to switch the heaters over to a series connection thereof. The switching is accomplished by a series/parallel selector 21 which may be, for example a conventional switch. Although the inside surface of the outer conduit 12 is disposed at a preferably substantially uniform spacing from the surface of the heater arrangement 11, it could also be in restricted or occasional contact, as at points or over short portions of the surface thereof.

The coaxial and vertical arrangement of the conduit 6, heater arrangement 11 and conduit 12 in the lower part of the dishwashing machine has been found to be a particularly good practical configuration, as, while occupying a relatively small amount of space, this arrangement provides for an unhindered flow of the fluids to be supplied to the dishwashing machine, while also giving ease of mounting and replaceability of the arrangement of the distributor arms.

Other forms of heater arrangements can also be provided instead of the tubular coil-form heaters as indicated at 11 in the illustrated embodiment. Thus, the flow conduit 6 may be formed by a pressure cast member which on its outer surface has grooves of a helical configuration, for receiving heating coils and insulating material.

It will further be appreciated that the continuous-type or through-flow heater of the described embodiment, comprising a conduit 6, one or more heaters 11 and a conduit 12, is suitable not only for use in dishwashing machines but also generally for any situation in which two different and separate fluid flows, for example water and air, are to be heated simultaneously or successively. Thus for example, water which is to be heated, for example for the purposes of washing hands, may be passed through the conduit 6. After the hand washing operation, a flow of heating air is passed through the annular space defined between the conduits 6 and 12, the air flow being suitably heated by the heater arrangement 11 and then being used to dry the hands which had been previously washed. Therefore, a wash basin with such an arrangement would also have a hot air discharge nozzle, in addition to the hot water faucet. The hot water faucet is connected to the conduit 6 by a tube portion, and the hot air discharge nozzle is connected to the conduit 12 by a further tube portion. After the hot water faucet is turned off, at the end of the washing operation, the blower 14 is switched on by means of a pressure regulator (not shown) and a time switch. After the time set by the time switch has elapsed, the blower 14 and the heater arrangement 11 are automatically switched off.

Various modifications and alterations, may be made in the above-described embodiments without thereby departing from the spirit and scope of the present invention and such modifications and alterations are accordingly to be deemed being within the scope of the invention.

I claim:

1. A dishwashing machine comprising:

a vessel adapted to receive items to be washed and dried;

a first flow conduit for carrying a flow of dish-washing liquid to said vessel;

a second flow conduit for carrying a flow of drying air for drying items in said vessel; and a heating means operatively associated with said first and second flow conduits, for heating the washing liquid flowing through the first flow conduit during a washing operation and for heating the flow of drying air through the second conduit during a drying operation.

2. A machine as set forth in claim 1 wherein the heating means is disposed in the bottom of the machine below the vessel adapted to receive items to be washed and dried.

3. A machine as set forth in claim 1 comprising a distributor means for blowing hot air on to said items during a drying operation.

4. A machine as set forth in claim 1 wherein the heating means is disposed around the first flow conduit for the washing liquid and coaxially therewith, and the second flow conduit is disposed around the assembly of the first flow conduit and the heating means therearound.

5. A machine as set forth in claim 4 wherein the assembly of said first conduit, said heater means therearound and said second conduit is disposed in a vertically extending position in a lower part of the machine.

6. A machine as set forth in claim 5 which further comprises a rotary distributor assembly for distributing washing liquid and drying air over the items to be washed and dried, and wherein said assembly of first conduit, heater means and second conduit is disposed below and coaxially with the axis of rotation of the distributor assembly.

7. A machine as set forth in claim 6 wherein said distributor assembly comprises a first distributor arm means and a second distributor arm means disposed at a higher level in the machine than the first distributor arm means.

8. A machine as set forth in claim 7 wherein the interior of the first distributor arm means is divided into first and second regions, the first region being disposed above the second region in the distributor arm means and communicating the first conduit with spray nozzles for spraying the washing liquid, and the second region communicating the second conduit with air discharge nozzles for discharging drying air.

9. A machine as set forth in claim 6 wherein said second conduit forms a rotary mounting support means for the rotary distributor assembly.

10. A machine as set forth in claim 1 wherein said heating means comprises a plurality of heaters, and including a control means for the heaters, operable to provide for parallel connection of the heaters during a dishwashing operation thereby to heat the washing liquid passing through the first conduit, and operable to provide for series connection of the heaters during a drying operation thereby to heat the flow of drying air flowing over the heating arrangement in the second flow conduit.

11. A dishwashing machine comprising:

a housing for receiving items to be washed and dried;

distributor means disposed within said housing for distributing washing liquid and drying air in the housing;

a first flow conduit for carrying washing liquid to the distributor means;

a second flow conduit for carrying drying air to the distributor means, said second flow conduit being disposed around and surrounding the first flow conduit; the walls defining said first and second conduits being spaced from each other; and a heating means disposed in the space between the first and second flow conduits and operable to heat washing liquid flowing through the first conduit by heat transfer through the wall of the first conduit and operable to heat air flowing through the second flow conduit by heat transfer to the air flowing over the heating means.

12. A machine as set forth in claim 11 wherein said first flow conduit, said heating means and said second flow conduit are disposed coaxially.

13. A machine as set forth in claim 12 wherein said heating means comprises at least one tubular heater which is disposed in a coil winding around the first flow conduit.

14. A machine as set forth in claim 13 wherein said heating means comprises a plurality of heaters operable selectively in a series circuit and in a parallel circuit.

* * * * *